United States Patent [19]

Cerrone

[11] Patent Number: 4,781,564

[45] Date of Patent: Nov. 1, 1988

[54] APPARATUS FOR REFORMING SOAP BARS

[76] Inventor: Carmen J. Cerrone, 1811 W. Palm Dr., Mt. Prospect, Ill. 60056

[21] Appl. No.: 60,486

[22] Filed: Jun. 11, 1987

[51] Int. Cl.[4] ..... B28B 3/00; B28B 11/14

[52] U.S. Cl. ..... 425/289; 241/273.2; 241/273.3; 264/37; 264/152; 264/DIG. 69; 425/297; 425/318; 425/324.1; 425/412; 425/442; 425/457

[58] Field of Search ..... D7/47, 372, 414; 264/37, 73, 75, 152, 349, DIG. 66, DIG. 69; 425/84, 193, 208, 289, 292, 294, 296, 297, 300, 305.1, 318, 406, 442, 443, 117, 324.1, 412, 425, 457; 241/168, 273.2, 273.3, 293

[56] References Cited

U.S. PATENT DOCUMENTS

| | | | |
|---|---|---|---|
| 1,606,729 | 11/1926 | Boal et al. | 425/442 |
| 1,782,076 | 11/1930 | Safford, Sr. | 425/318 |
| 2,021,794 | 11/1935 | Leone | 425/193 |
| 2,380,892 | 7/1945 | White | 425/318 |
| 2,529,473 | 11/1950 | Rustici | D7/47 |
| 2,563,839 | 8/1951 | Hoopes | 425/297 |
| 2,804,896 | 9/1957 | Silberberg | D7/47 |
| 3,329,318 | 7/1967 | Swett et al. | D7/47 |
| 3,466,707 | 9/1969 | Click et al. | 425/193 |
| 3,522,633 | 8/1970 | Cubitt | 425/193 |
| 4,310,479 | 1/1982 | Ooms et al. | 264/75 |
| 4,389,119 | 6/1983 | Valsamis et al. | 264/349 |
| 4,468,872 | 9/1984 | Korte | 425/208 |

*Primary Examiner*—Jay H. Woo
*Assistant Examiner*—C. Scott Bushey
*Attorney, Agent, or Firm*—Charles F. Lind

[57] ABSTRACT

The disclosed apparatus defines a soap press component and a grinding component, operatively associated with one another. The grinding component has an inlet for receiving small soap bars or end pieces, and means for grinding them up to even finer pieces or shavings. The soap press component has wall structure defining a chamber having open top and bottom ends; a removable bottom wall is used to close the open bottom end, and a movable upper shaping form is used to close the open top end. A rotatable screw connected to the upper shaping form provides for moving such form from an elevated position spaced above the open top chamber end, to a lowered position extended into and through the chamber. The grinding component outlet discharges the soap pieces or shavings to above the open top chamber end; whereby they drop then into the chamber from the open top end thereof. Rotation of the screw moves the upper mold plate axially into the chamber and against such soap shavings, to pressure form them into a single bar shaped the same as the chamber. The shaped bar is removed from the chamber bottom end, upon opening the bottom wall, by shifting it to an opened position laterally offset from the open bottom end of the chamber.

9 Claims, 2 Drawing Sheets

APPARATUS FOR REFORMING SOAP BARS

BACKGROUND OF THE INVENTION

Soap bars, as originally made and sold, are sized to be held in one's hand; but use of a bar with water reduces its size eventually to something too small and/or too pliable for gripping when wet and slippery. Waste is common then, with such soap bar ends frequently merely being thrown away or being washed down the drain.

It is possible to squeeze several small wet soap bar ends together, such as in one's hand, to define a larger usable bar. Lines between the separate bar ends remain in the newly formed bar, and the overall shape of such a bar frequently is glob-like; each detracting from the appeal of the bar.

SUMMARY OF THE INVENTION

This invention relates to apparatus for mechanically reforming soap bars, typically many small scraps or ends of such bars, to a single bar of a usable size and/or specific shape. Besides using these many soap bar ends for effectively economizing, the invention allows different soaps to be blended together for improved cleansing and/or conditioning, and allows the use of selective shaping forms or molds in the apparatus to achieve specific novelty shapes or the like for entertaining.

The apparatus includes a press component having a chamber defined in part by side walls, and having open top and bottom ends. A bottom wall, including a lower shaping form, is mounted to be moved to a closed position across the open bottom end of the chamber, or to an opened position laterally offset from the open bottom end of the chamber. An upper shaping form is mounted to be moved into the open top end of the chamber, from an elevated position otherwise spaced above the top chamber end. A grinding component has an inlet opening for receiving small soap bar pieces, an outlet that opens to above the open top end of the chamber, and grinding means between the inlet and outlet operable to chop or grate the small soap pieces into even finer shavings, which drop then into the press chamber. The upper forming plate may then be moved axially into the chamber and against such soap shavings, pressure forming the shavings into a single bar shaped the same as the chamber side walls and the upper and lower shaping forms. The shaped bar may be removed from the open bottom end of the chamber, upon removing the bottom wall.

DETAILED DESCRIPTION OF ILLUSTRATED EMBODIMENTS

The illustrated embodiments are suited for forming a single bar of soap from many smaller bars or scrap pieces of soap, that otherwise would be thrown away or washed down the drain, as they become too small and difficult to handle and use.

Figure 1:
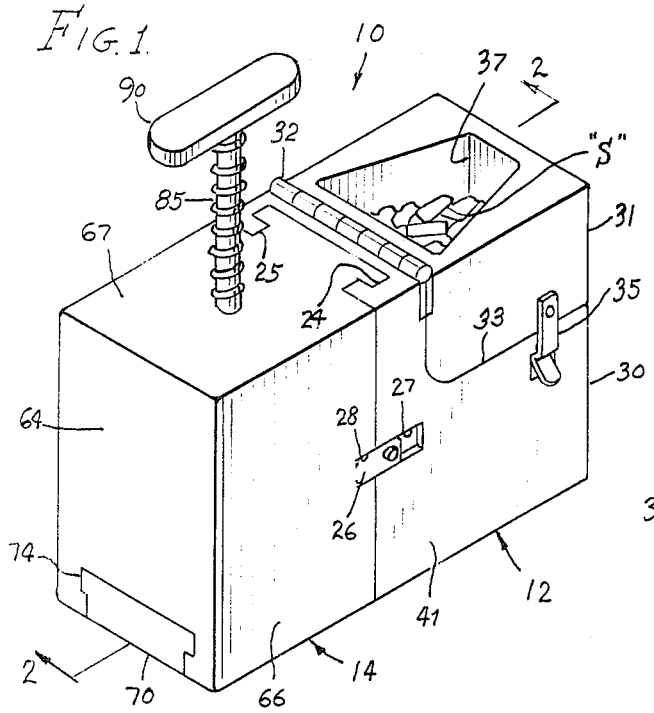
FIG. 1 is a perspective view of a first embodiment of apparatus for recycling soap bar pieces, illustrating a grinding component and a press component secured together in an operative association.
Figure 3:
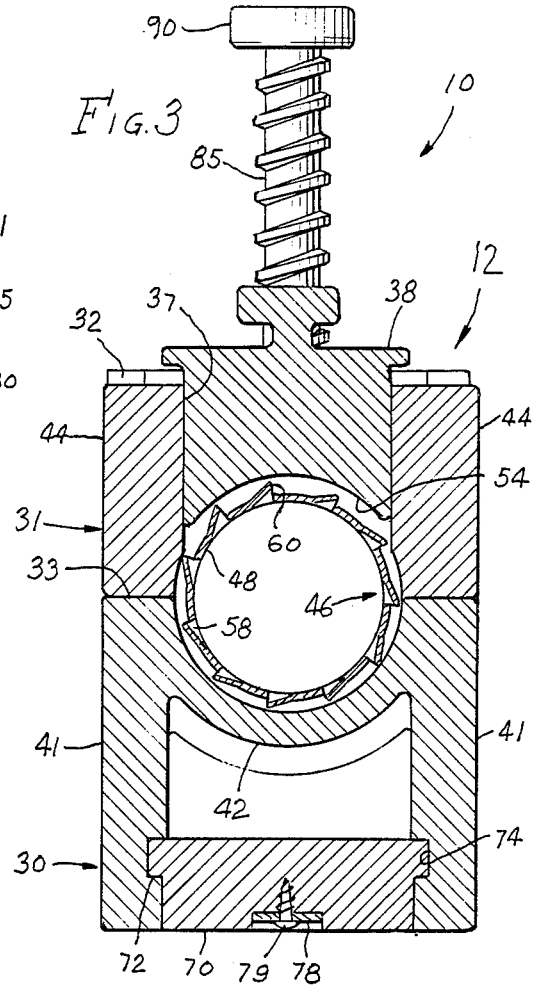
FIG. 3 is a sectional view, as taken generally from line 3—3 in FIG. 2.
Figure 2:
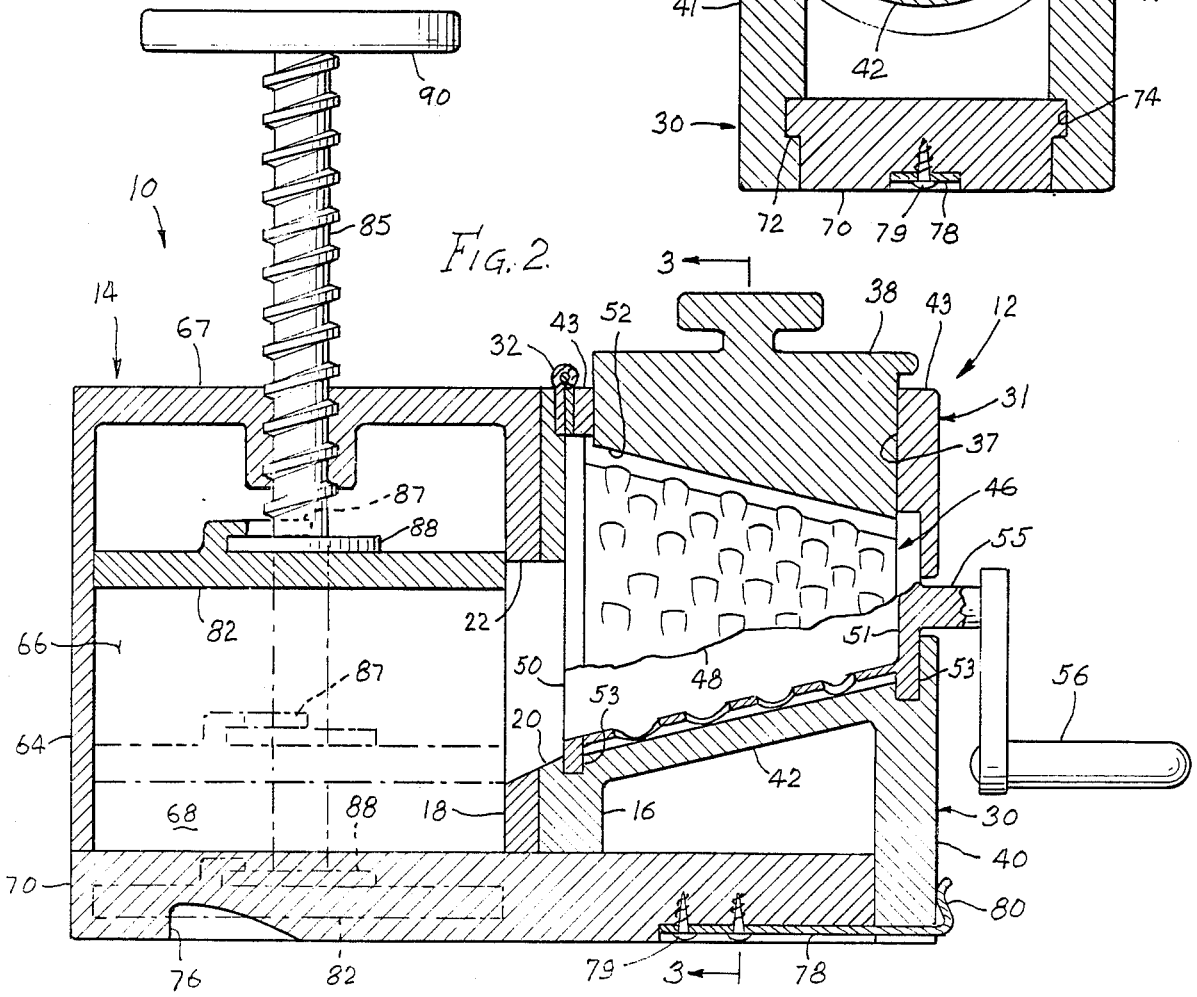
FIG. 2 is a sectional view, in a somewhat larger scale, as taken generally from line 2—2 in FIG. 1.

The apparatus 10 of FIGS. 1–3 includes grinding component 12 and press component 14, secured together in side-by-side operative association. Each component 12 and 14 is somewhat of a hollowed block, having adjacent side walls 16 and 18 butted against one another, and having openings 20 and 22 in the side walls aligned with one another to communicate the interiors of the components 12 and 14 with one another.

Figure 4:
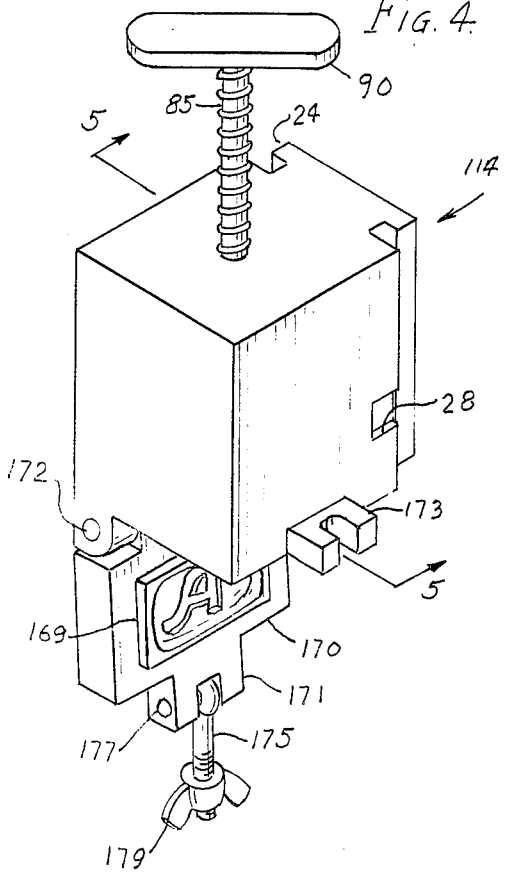
FIG. 4 is a perspective view, similar to FIG. 1, except illustrating a second embodiment of a press component isolated by itself, and in an opened position.
Figure 5:
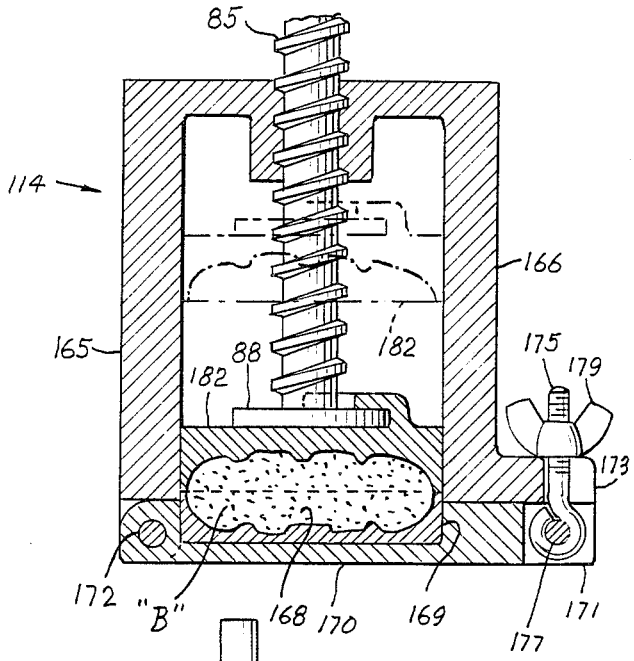
FIG. 5 is a sectional view, as taken generally from line 5—5 in FIG. 4, except in the closed position.
Figure 6:
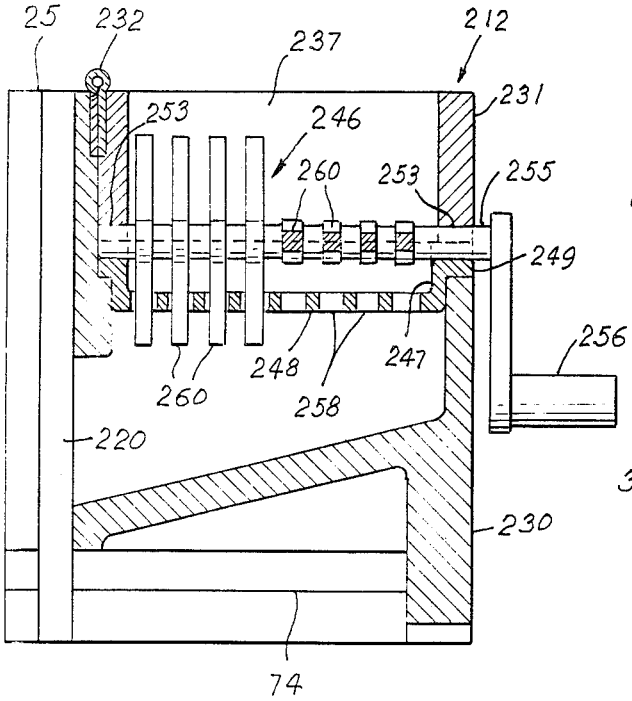
FIG. 6 is a sectional view, similar to FIG. 2, except illustrating a second embodiment of a grinding component isolated by itself.
Figure 7:
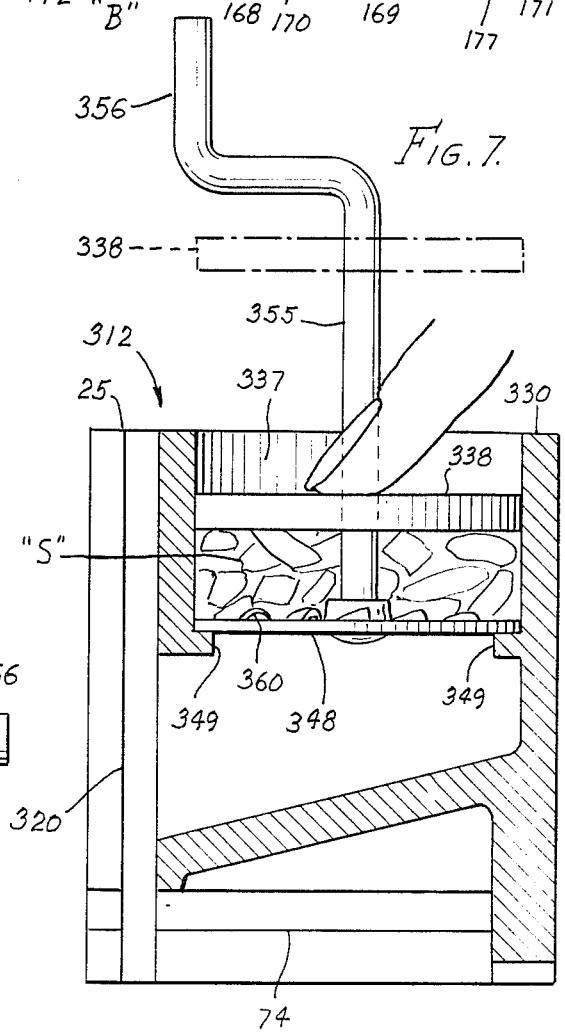
FIG. 7 is a sectional view, similar to FIG. 6, except illustrating a third embodiment of a grinding component isolated by itself.

Different embodiments of the components 12 and 14 are also illustrated, including press component 114 of FIGS. 4 and 5; and grinding components 212 and 312 of FIGS. 6 and 7, respectively. The press and grinding components are interchangable, so that it will be appreciated that any illustrated grinding component 12, 212 or 312 may be used with either press components 14 or 114. The specific structures of each will now be disclosed.

The different grinding and press components illustrated have cooperating tongue and groove configurations 24 and 25 respectively formed therein, outwardly adjacent the side walls 16 and 18, to allow the components to be separated and/or joined together and laterally interlocked. When so laterally interlocked, and properly aligned top-to-bottom, latches 26 (only one being shown in FIG. 1) may be shifted transverse to the component side walls to axially hold the components 12 and 14 as so aligned. The illustrated latch 26, in the locking position, fits in tracks 27 and 28 in the grinding and press components 12 and 14, respectively; while, in the releasing position, the latch may be shifted clear of the press component 14 to fit completely within the grinding component track 27.

The grinding component 12 includes main frame element 30 and cap element 31 hinged together at 32, and complementing one another along parting line 33. Latches 35 secured to cap 31 cooperate with shoulders on the frame 30, to hold the elements 30 and 31 releasably locked together in the closed position. The cap element 31 has a top through opening 37 into which the small soap end pieces "S" may be inserted; and a plug 38 (shown only in FIGS. 2 and 3) may be fitted into the top opening 37 to close the opening, and to push any such soap pieces into the grinding component 12.

The frame element 30 has the side wall 16 and its opposing side wall 40, and opposing side walls 41, the respective walls meeting at the vertical corners of the grinding component 12 to define a continuous periphery. A cross wall 42 extends between the side walls 16, 40 and 41, and lines up with and/or defines the lower edge of the side opening 20. The cap element 31 has opposing pairs of side walls 43 and 44 meeting at the vertical corners of the grinding component 12 to define a continuous periphery around the through opening 37.

A grinder 46 is mounted between the elements 30 and 31, in the region of the parting line 33. The grinder 46 has a frustro conical peripherial wall 48 ending at a large open end 50, and end wall 51 closes the small grinder end. The grinder 46 is supported at bearing regions 53 to be rotated about a generally horizontal axis, with its peripherial wall 48 just spaced above the frame cross wall 42 and below the lower face 54 of the plug 38. To provide for this, the cross wall 42 is inclined downwardly and the plug face 54 is inclined upwardly and each is expanded in a somewhat frustro conical manner, in the direction from wall 40 to wall 16.

A shaft 55 extended off of the end wall 51 substantially concentrically of the peripherial wall, and a handle 56 keyed to but laterally offset from the shaft 55, allow easy manual rotation of the grinder 46. The grinder 46 may be inserted into or removed from the grinding component 12, upon the cap element 31 being rotated about the hinge 32 over perhaps a quarter of a turn from the closed position illustrated, to a opened position (not shown).

The grinder wall 48 lies crosswise to the top opening 37, and separates the top inlet opening from the side outlet opening 20 of the grinding component. Many spaced holes 58 are formed in the grinder wall 48, with a radially enlarged cutting scoop 60 over each hole. It is apparent that soap pieces pushed against the outlet side of the moving grinder wall 48 will be cut up by the scoops 60 and forced through the holes 58 to the inlet side of the wall.

The press component 14 has a singular frame element, with side wall 18 and its opposing side wall 64, and opposed side walls 66, that are peripherially continuous and aligned somewhat along a vertical longitudinal axis. Top cross wall 67 is continuous with the upper ends of the side walls 18, 64 and 66, while the bottom ends of the side walls are open. A press chamber 68 is defined in the region between the peripherially continuous side walls 18, 64 and 66, below the side opening 22 and above the open bottom end.

A bottom wall 70 comprises a lower shaping form to selectively close the open bottom end of the chamber 68. The bottom wall 70 may be substantially flat; and substantially straight opposite side edges or lips 72 on the wall may be slidably received in a pair of opposed grooves 74 located in the side walls 41 and 66 of the components. The bottom wall 70 may be laterally moved between one position disposed across and closing the open bottom end of the chamber 68 as illustrated in FIG. 2, and another position (not shown) to the left of that illustrated in FIG. 2 where it is laterally offset from the open bottom end. A finger notch 76 may serve as a handle in sliding the bottom wall 70 within the grooves. Spring leaf 78, secured at one end to the bottom wall 70 by fastener 79 and having the opposite end bent as a hook 80, overlaps the grinding component wall 40 and locks the bottom wall 70 in the closed position.

An upper shaping form 82, having side edges adapted to fit with reasonably close tolerances next to the chamber side walls 18, 64 and 66, fits into and is mounted to be moved through the press chamber 68. A screw 85, threaded in the frame cross wall 67 and extended coaxially of the chamber side walls, is rotatably connected to the plate 82. This connection is illustrated in the form of a U-shaped lip 87 spaced slightly off of the plate and laterally fitted over a circular flange 88 on the screw 85. The screw 85 is sufficiently long to move flange 88 below the lower edge of the side wall 64 (as illustrated in the lower phantom in FIG. 2), whereupon the shaping form 82 may be fitted onto the screw flange. When the screw 85 is threaded up slightly to move the flange and the form 82 above the side wall 64 (as illustrated in the upper phantom in FIG. 2), the form becomes axially keyed to the screw while allowing screw rotation. A handle 90 keyed to the screw 85 above the wall 67 eases manual rotation of the screw.

To operate the apparatus, the small pieces "S" of soap ends may be put into the top opening 37 of the grinding component 12, and pushed by plug 38 against the peripherial wall 48 of the grinder. With the upper shaping form 82 elevated above the top of the chamber opening 22, rotation of the grinder 46 effectively reduces the small soap pieces into even finer soap shavings, which are funnelled then by gravity from the large open end of the grinder into the press chamber 68, and supported on the lower shaping form of the bottom wall 70. After the chamber 68 has been filled with the soap shavings to the level desired, rotation of the screw 85 moves the upper form 82 axially into the chamber 68, and against such soap shavings, to pressure reform them into a single bar (not shown) shaped the same as the chamber side walls 18, 64 and 66, and the upper lower shaping forms 82 and 70.

For better results, the small soap pieces "S" should be basically dry, and sufficiently small to fit easily into the loading top opening of the grinding component 12. This allows for more effective reduction of the soap pieces, to yield fine shavings, and allows good blending of the shavings in the chamber before they are compressed. The slight moisture in the shavings provides sufficient adhesion, upon being squeezed by the mechanical pressures of the press, to retain the single soap bar as shaped. The press forming plate 82 should be tightened down against the shavings in stages: slightly at first, then backed off some, and then retightened even more, to yield a soap bar uniform both in shape and texture. A soft or buoyant bar may be generated with only slight compression forces, or a hard or dense bar may be generated with higher compression forces.

To remove the shaped soap bar from the press chamber 68, the screw 85 may be backed off slightly to reduce mechanical pressures between the bottom wall form 70 and the soap bar, and the bottom wall may then be shifted laterally to the open position offset from the open chamber bottom. The screw may then be turned to advance the upper shaping plate 82 into the press chamber, to push the soap bar out the open bottom end of the press chamber.

The basic configurations of press component 114 of FIGS. 4 and 5 are similar to those of press component 14, and are numbered the same. However, bottom wall 170 is hinged at 172 to the lower edge of one side wall 165, to be pivoted between the opened position (FIG. 4) and the closed position (FIG. 5) relative to the open bottom end of the press chamber. The bottom wall 170 may have a yoke 171 extended to beyond the opposite side wall 166; and such opposite side wall 166 may have a corresponding opposing yoke 173. A locking member or threaded bolt 175 is hinged on pin 177 extended through aligned openings in the bottom wall yoke 171, capable of being to rotated to be within the side wall yoke 173. A wing nut 179 threaded on the bolt 175 and tightened down against the side wall yoke 173 holds the bottom wall in the closed position.

A lower shaping form 169 is carried removably in a recess in the bottom wall 170, to line up with and face upper shaping form 182 rotatably carried on the flange 88 of screw 85. The lower and upper shaping forms 169 and 182 together define the press chamber 168; and a shaped bar "B" of soap is illustrated in the chamber.

Although other modifications may be provided, the illustrated lower shaping form has a letter "A" therein, for producing a correspondingly monogrammed soap bar. Moreover, to form a different soap bar as desired, the removable lower shaping form 169 and/or upper shaping form 182 may be replaced by another form (not shown), defining a differently shaped or highlighted press chamber.

The grinding component 212 of FIG. 6 has a grinder 246 including a plate member with a generally flat cross wall 248, a slight axial wall 247 formed off of this cross wall, and a radial lip 249 formed off of the axial wall. The cross wall 248 separates the top inlet opening 237 in the cap 231 from the side outlet opening 220 in the main frame 230, except for a number of parallel throughslots or holes 258 formed therein. A shaft 255 is supported at bearing regions 253 relative to the frames 230 and 231, to rotate about a horizontal axis spaced above the cross wall 248. Radial fingers 260 keyed to the shaft 255 are aligned respectively with and disposed to extend through the parallel throughslots 258. The fingers 260 may be in two separate groups angled 90 degrees from one another.

Shaft rotation thus moves the fingers 260 respectively into and out of the throughslots 260, which breaks up the larger soap pieces on the upper or inlet side of the cross wall 248, and forces the soap as finer shavings or the like to the lower or outlet side of the cross wall. An offset handle 256 keyed to the shaft 255 may be used to rotate the grinder 246 manually. The grinder plate and shaft 255 are removably received and held in appropriate recesses, in the parting line region, between the main and cap frames 230 and 231, upon rotating the frames relatives to one another about the hinge 232.

The grinding component 312 of FIG. 7 has a singular frame 330, with a top inlet opening 337 and a side outlet opening 320. A ledge 349 formed off of the frame 330, supports a cross or grate wall 348. The grate wall 348 has a plurality of throughholes therein, each with an overlying cutting scoop 360. The grate wall separates the top opening 337 from the side outlet opening 320, except for the throughholes formed therein. Shaft 355 is keyed to the grate wall 348 and extends normally thereto, in a somewhat vertical direction. A pusher plate 338 is mounted to rotate on the shaft 355, and to move axially of the shaft. The pusher plate 338 fits with reasonably close tolerances against the side wall of the frame 330; so that this plate with its rotatable connection to the shaft 355, and the ledge-mounted grate wall 348 with its rotatable connection to the shaft rotatably support the shaft 355.

Soap pieces "S" may be loaded onto the grate wall 348, when the pusher plate 338 is elevated to the position illustrated in phantom; above the open top of inlet opening 337. Rotation of the shaft 355, accompanied by downward movement of the pusher plate 337 against the soap pieces "S" forces such soap pieces as finer shavings or the like, through the throughholes in the cross wall to the outlet side of the cross wall. An offset handle 356 on the shaft 355 may be used to rotate the gringer wall 348 manually.

In each illustrated embodiment, the components are preferably formed of a durable structural material that will be inert with respect to the soap to used in the apparatus. Thus, a hard wood and/or a molded plastic are preferred. Any build-up of the soap, in the grinder component, or press component, may be easily washed away, by soaking the apparatus directly in water. The fact that the grinder means is separate and removable from the overall component aids in this cleanup.

It should be noted that the disclosed apparatus may be used to blend soap to different formulations than any single produce sold and available commerically. Thus, different brands and/or types of soap bars, even new and unused, may be selected according for example to a blend of deodorant, oil, or lathering soaps, to yield a precise and/or unique blend.

Although the invention has been described with respect to specific illustrated embodiments; it should be understood that the invention is to be limited only according to the following claims.

What is claimed as my invention is:

1. Apparatus for forming a single bar of soap from smaller soap bars and end pieces, comprising the combination of a grinding component and a press component operatively associated with one another as a single unit that is substantially portable and suited to be handheld;

said press component defining a tubular cavity having an open bottom end;

a bottom wall, and means for supporting the bottom wall relative to the press component for movement between a closed position as a lower shaping form disposed across the open bottom cavity end and an open position laterally offset from and exposing the open bottom cavity end;

an upper shaping form sized to fit closely within the tubular cavity, and means for moving the upper shaping form between a raised position spaced above the open bottom cavity end, and a lowered position near the open bottom cavity end and the lower shaping form;

said grinding component defining an outlet located vertically between the raised and lowered positions of the upper shaping form and communicating with the tubular cavity at this location, and having an inlet spaced vertically above the outlet for receiving said smaller soap bars and end pieces;

grinder means within the grinding component between the inlet and outlet for breaking up the smaller soap bars and end pieces into fine shavings, for discharge from the outlet, into the tubular cavity between the upper and lower shaping forms, when the upper shaping form is in the raised position;

said upper shaping form being adapted to the moved past the outlet of the grinding component and against such fine soap shavings to reform them into a single bar the same shape as the tubular cavity below the outlet and between the upper and lower shaping forms; and the formed bar being adapted to be removed from the bottom cavity end, upon the bottom wall being moved to the laterally offset open position and the upper shaping form being moved within the tubular cavity and against such formed bar.

2. Apparatus for forming a single bar of soap from smaller soap bars and end pieces, according to claim 1, further wherein said grinder means includes a plate disposed crosswise to and between the inlet and outlet of the grinding component, and having a number of openings therein;

a member having fingers respectively disposed to extend through the plate openings; and means to support said member to rotate about an axis substantially parallel to the plate so as to move the fingers respectively into and out of the openings.

3. Apparatus for forming a single bar of soap from smaller soap bars and end pieces, according to claim 1, further wherein said grinder means includes a plate disposed crosswise to and between the inlet and outlet of the grinding component;

said plate having a number of throughholes therein, and a cutting scoop over each of the throughholes;

said plate being shaped as a continuous symmetrical convolution;

means to support said plate to rotate about an axis substantially parallel to the axis of development of the convolution;

means to press the smaller soap bars and end pieces against the plate and cutting scoops; and said grinder means plate being shaped as a frustro conical member having the larger end open, and said open end being located adjacent the outlet of the grinding component.

4. Apparatus for forming a single bar of soap from smaller soap bars and end pieces, according to claim 3, further wherein said grinder means plate is supported to rotate about a generally horizontal axis.

5. Apparatus for allowing a consumer to form a single bar of soap from smaller soap bars and scrap end pieces, comprising the combination of a grinding component and a press component operatively associated to form a single unit sufficiently small to be portable and hand-held by the consumer;

the grinding component having means associated therewith, including having an inlet, operable to receive and hold said smaller soap bars and scrap end pieces;

the grinding component further having means to grind said smaller soap bars and scrap end pieces into fine shavings, and to have such shavings freely blended together at an outlet from the grinding component;

the press component having a tubular cavity with an open bottom end, and lower shaping form means moveable between a closed position disposed across and closing the open cavity end and an opened position laterally offset from and exposing the open cavity end;

an upper shaping form sized to fit closely within the tubular cavity, and means for moving the upper shaping form between a raised position spaced above the open cavity end, and a lowered position near the open cavity end;

means including an opening into the tubular cavity, at a location between the raised and lowered positions of the upper shaping form, and said opening being in direct communication with the outlet from the grinding component;

said fine shavings at the outlet of the grinding component thereby being operable to pass via said opening into the press component tubular cavity, at a location between the upper and lower shaping forms;

said upper shaping form being adapted to be moved then from said raised position toward the lowered position and against such fine soap shavings, to reform such soap shavings into said single bar between the upper and lower shaping forms; and the formed bar being adapted to be removed from the open end of the tubular cavity, upon the lower shaping form means being moved to the opened position and the upper shaping form being moved against such formed bar.

6. Apparatus for forming a single bar of soap from smaller soap bars and scrap end pieces, according to claim 5, wherein said grinding and press components are separate from one another; and further including cooperating means on the grinding and press components adapted to separably secure the components operatively fixed together.

7. Apparatus for forming a single bar of soap from smaller soap bars and scrap end pieces, according to claim 6, wherein said securing means is in the form of cooperating tongue and groove configurations respectively formed therein, outwardly adjacent the outlet of the grinding component and the opening of the tubular cavity.

8. Apparatus for forming a single bar of soap from smaller soap bars and scrap end pieces, according to claim 5, wherein the grinding component outlet is located below and laterally offset from the grinding component inlet, and wherein said grinding component outlet is located vertically above and laterally offset from the open bottom cavity end.

9. Apparatus for forming a single bar of soap from smaller soap bars and scrap end pieces, according to claim 5, wherein said grinding component has a hinged two piece frame adapted in an operating configuration to have parting lines adapted to cooperate with and be adjacent one another, and said grinder means within the grinding component being adapted to fit between the two-piece frames at the parting lines and be held thereat in said operating configuration.

* * * * *